US009845212B2

(12) United States Patent
Kameda

(10) Patent No.: US 9,845,212 B2
(45) Date of Patent: Dec. 19, 2017

(54) PAPER DELIVERY DEVICE

(71) Applicant: MURATA MACHINERY, LTD., Kyoto-shi, Kyoto (JP)

(72) Inventor: Tsuyoshi Kameda, Kyoto (JP)

(73) Assignee: MURATA MACHINERY, LTD., Kyoto (JP)

( * ) Notice: Subject to any disclaimer, the term of this patent is extended or adjusted under 35 U.S.C. 154(b) by 0 days.

(21) Appl. No.: 15/286,774

(22) Filed: Oct. 6, 2016

(65) Prior Publication Data

US 2017/0102661 A1 Apr. 13, 2017

(30) Foreign Application Priority Data

Oct. 13, 2015 (JP) ..... 2015-202239

(51) Int. Cl.
*B65H 5/06* (2006.01)
*B65H 29/70* (2006.01)
(Continued)

(52) U.S. Cl.
CPC ..... *B65H 5/062* (2013.01); *B65H 7/00* (2013.01); *B65H 9/10* (2013.01); *B65H 29/70* (2013.01);
(Continued)

(58) Field of Classification Search
CPC .... B65H 2301/3613; B65H 2301/3332; B65H 2301/512565; B65H 2301/51256;
(Continued)

(56) References Cited

U.S. PATENT DOCUMENTS 7,159,862 B2 * 1/2007 Matsutomo ..... B65H 29/14 271/207
7,532,855 B2 * 5/2009 Kajita ..... G03G 15/6576 399/405
(Continued)

FOREIGN PATENT DOCUMENTS

JP 63-180668 A 7/1988
JP 11-065192 A 3/1999
(Continued)

*Primary Examiner* — Patrick Cicchino
(74) *Attorney, Agent, or Firm* — Keating & Bennett, LLP

(57) ABSTRACT

A paper delivery device includes a shift frame movable in a second direction perpendicular or substantially perpendicular to a first direction along which paper is delivered to outside, a driver that moves the shift frame in the second direction, a drive roller with a first outer peripheral surface extending in the second direction and supported by the shift frame such that the drive roller is rotatable about a first shaft parallel or substantially parallel to the second direction, a first driven roller with a second outer peripheral surface extending in the second direction and contactable with the first outer peripheral surface at a first contact position, the first driven roller supported by the shift frame such that the first driven roller is rotatable about a second shaft parallel or substantially parallel to the second direction following the rotation of the drive roller, the first driven roller being rotated in a state where the paper is nipped between the first outer peripheral surface and the second outer peripheral surface thus transporting the paper in the first direction, and a second driven roller with a third outer peripheral surface extending in the second direction and contactable with the first outer peripheral surface at a second contact position downstream of the first contact position in the first direction, the second driven roller being supported by the shift frame such that the second driven roller is rotated about a third shaft disposed parallel or substantially parallel to the second
(Continued)

direction following the rotation of the drive roller, the second driven roller being rotated in a state where the paper which is nipped between the first outer peripheral surface and the second outer peripheral surface is nipped by the first outer peripheral surface and the third outer peripheral surface thus transporting the paper in the first direction.

5 Claims, 12 Drawing Sheets

(51) Int. Cl.
*B65H 9/10* (2006.01)
*B65H 7/00* (2006.01)
*G03G 15/00* (2006.01)

(52) U.S. Cl.
CPC . *G03G 15/6576* (2013.01); *B65H 2301/3613* (2013.01); *B65H 2404/732* (2013.01); *B65H 2801/06* (2013.01); *G03G 15/6529* (2013.01)

(58) Field of Classification Search
CPC ..... B65H 2404/732; G03G 15/6576; G03G 2215/00662
See application file for complete search history.

(56) References Cited

U.S. PATENT DOCUMENTS

| | | | | |
|---|---|---|---|---|
| 7,845,634 | B2 * | 12/2010 | Asakawa | B65H 29/22 271/200 |
| 7,865,128 | B2 * | 1/2011 | Lee | G03G 15/6552 271/188 |
| 8,485,523 | B2 * | 7/2013 | Kimura | B65H 31/26 271/220 |
| 8,998,196 | B2 * | 4/2015 | Tsuda | B65H 5/062 271/188 |
| 9,227,814 | B2 * | 1/2016 | Zhang | B65H 29/14 |
| 2004/0156032 | A1 * | 8/2004 | Murakami | G03B 27/00 355/407 |
| 2006/0153624 | A1 | 7/2006 | Maeda et al. | |
| 2017/0008713 | A1 * | 1/2017 | Yamaguchi | G03G 15/6529 |

FOREIGN PATENT DOCUMENTS

| | | | |
|---|---|---|---|
| JP | 2000-272802 | A | 10/2000 |
| JP | 2013-006633 | A | 1/2013 |
| JP | 2013-043759 | A | 3/2013 |

* cited by examiner

PAPER DELIVERY DEVICE

CROSS-REFERENCE TO RELATED APPLICATIONS

This application claims priority under 35 U.S.C. 119 to Japanese Patent Application No. 2015-202239 filed on Oct. 13, 2015, which application is hereby incorporated by reference in its entirety.

BACKGROUND OF THE INVENTION

1. Field of the Invention

The present invention relates to a paper delivery device provided in an image forming apparatus for forming an image on a paper and delivers the paper on which the image is formed to the outside.

2. Description of the Related Art

Conventionally, there has been known an image forming apparatus which delivers papers on which images are formed to a paper exit tray while sorting the papers in accordance with the number of copies. For example, there has been known an image forming apparatus equipped with a shift frame which is slidable back and forth in a roller axis direction of a paper delivery roller.

In this image forming apparatus, the shift frame is moved in the direction perpendicular or substantially perpendicular to a paper feeding direction of papers and, thereafter, papers on which images are formed are delivered to a paper exit tray (shift sort).

Further, in the image forming apparatus which forms images on papers by electrophotography, at the time of heating a paper for fusing toner to the paper, moisture is evaporated from a heated surface of the paper. It has been known that, as a result of the evaporation of moisture, the heated surface of the paper is contracted so that the paper curls.

To prevent such curl, there has been known a paper delivery device equipped with a decurling mechanism which eliminates curl generated on a paper by a plurality of driven rollers which are brought into contact with a curved surface of a drive roller at the time of delivering the paper.

Conventionally, in mounting the shift sorting mechanism and the decurling mechanism described above on the image forming apparatus, these mechanisms are mounted separately from each other. As a result, it has been impossible to downsize the image forming apparatus having functions of both mechanisms.

SUMMARY OF THE INVENTION

Preferred embodiments of the present invention provide a paper delivery device of an image forming apparatus in which a mechanism that performs a shift sorting function and a mechanism that performs a decurling function are housed in a compact manner.

A plurality of preferred embodiments of the present invention are described hereinafter. Elements, features, or characteristics of the various preferred embodiments of the present invention can be arbitrarily combined with each other when necessary.

According to a preferred embodiment of the present invention, there is provided a paper delivery device which is provided in an image forming apparatus to form an image on a paper, and delivers the paper on which the image is formed to the outside. The paper delivery device includes a shift frame, a driver, a drive roller, a first driven roller, and a second driven roller.

The shift frame is movable in a second direction perpendicular or substantially perpendicular to a first direction along which the paper is delivered to the outside. The driver moves the shift frame in the second direction.

The drive roller includes a first outer peripheral surface extending in the second direction, and is supported by the shift frame such that the drive roller is rotatable about a first shaft disposed parallel or substantially parallel to the second direction.

The first driven roller includes a second outer peripheral surface which extends in the second direction and is brought into contact with the first outer peripheral surface at a first contact position. The first driven roller is supported by the shift frame such that the first driven roller is rotatable about a second shaft disposed parallel or substantially parallel to the second direction following the rotation of the drive roller. The first driven roller is rotated in a state where the paper is nipped between the first outer peripheral surface and the second outer peripheral surface thus transporting the paper in the first direction. "nip" means clamping the paper between two rollers.

The second driven roller includes a third outer peripheral surface which extends in the second direction and is brought into contact with the first outer peripheral surface at a second contact position downstream of the first contact position in the first direction. The second driven roller is supported by the shift frame such that the second driven roller is rotatable about a third shaft disposed parallel or substantially parallel to the second direction following the rotation of the drive roller. The second driven roller is rotated in a state where the paper which is nipped between the first outer peripheral surface and the second outer peripheral surface is nipped by the first outer peripheral surface and the third outer peripheral surface thus transporting the paper in the first direction.

In the above paper delivery device, at the time of delivering the paper on which an image is formed, the paper which is nipped between the first outer peripheral surface of the drive roller and the second outer peripheral surface of the first driven roller at the first contact position is nipped between the first outer peripheral surface of the drive roller and the second outer peripheral surface of the second driven roller at the second contact position. With such a configuration, it is possible to curve the nipped paper in the direction opposite to the direction of curl formed on the paper. As a result, it is possible to eliminate curl generated on the nipped portion.

In the above paper delivery device, the drive roller, the first driven roller and the second driven roller are supported by the same shift frame. With such a configuration, it is possible to realize the compact paper delivery device that performs both a shift sorting function and a decurling function. As a result, an image forming apparatus equipped with the paper delivery device is able to be downsized.

In an operation for delivering the paper in the paper delivery device after moving the paper to a different position in the second direction, the paper delivery device may perform an operation in which (i) the paper is transported due to rotation of the drive roller until a rear edge of the paper in the first direction is released from nipping between the first outer peripheral surface and the second outer peripheral surface and the rear edge of the paper is nipped between the first outer peripheral surface and the third outer peripheral surface, (ii) the rotation of the drive roller is stopped in a state where the rear edge of the paper in the first direction is nipped only between the first outer peripheral surface and the third outer peripheral surface, (iii) the driver moves the shift frame in the second direction while the rear edge of the paper in the first direction is nipped between the first outer peripheral surface and the third outer peripheral surface; and (iv) the paper is delivered from between the drive roller and the second driven roller by rotating the drive roller.

With such an operation, during the movement of the shift frame in the second direction, the paper is not brought into a curved state due to nipping by three rollers. Accordingly, it is possible to prevent the generation of nip marks on the paper during the movement of the paper in the second direction.

Thus, with preferred embodiments of the present invention, a mechanism that performs a shift sorting function and the mechanism that performs a decurling function are housed in the paper delivery device of the image forming apparatus in a compact manner.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
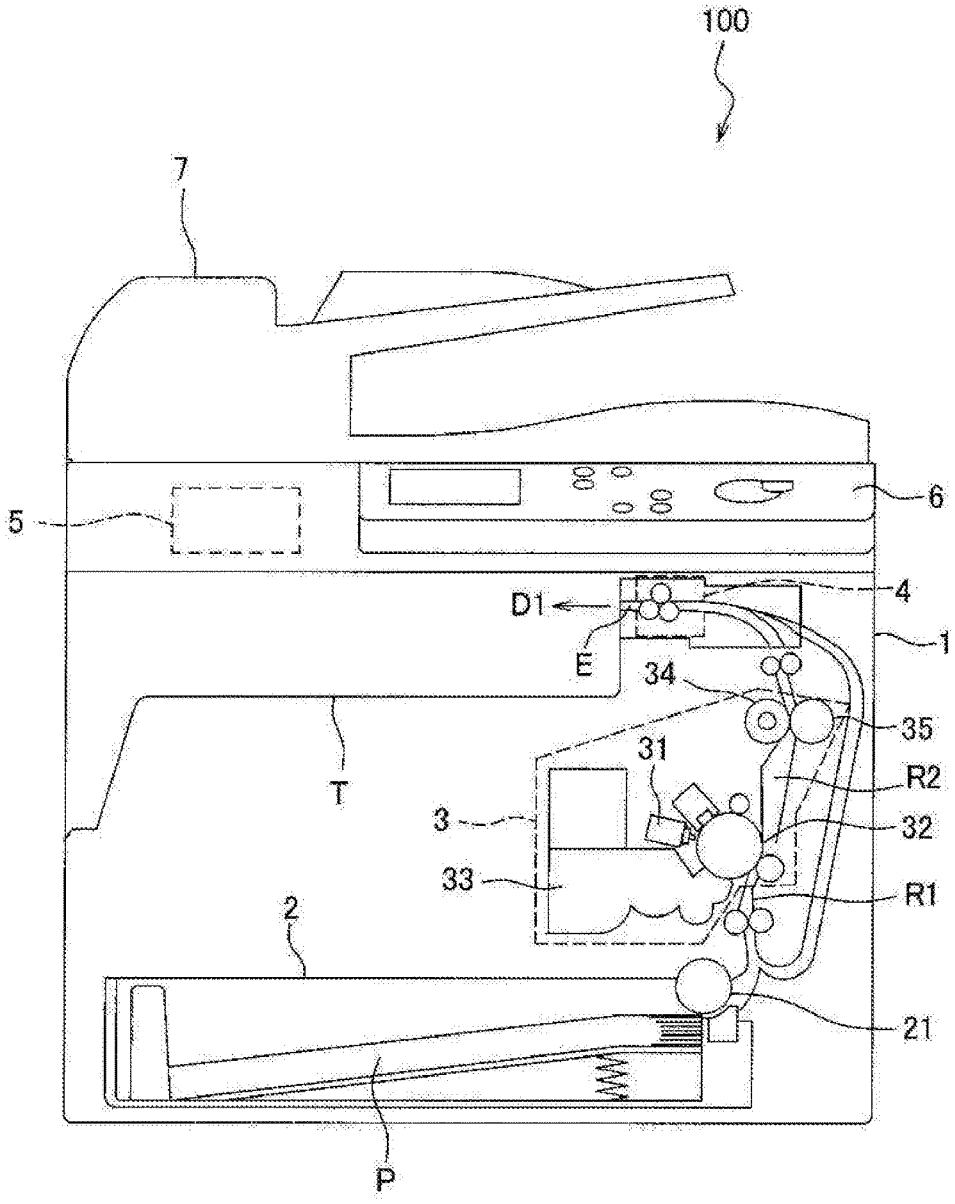
FIG. 1 is a partial cross-sectional view illustrating an image forming portion of an image forming apparatus.

The preferred embodiments described hereinafter describe preferred specific examples of the present invention. In the preferred embodiments described hereinafter, numerical values, shapes, materials, elements, the arrangement positions and connection states of the elements, operational steps, the order of operational steps and the like are merely examples, and these are not intended to limit the present invention.

First Preferred Embodiment

Hereinafter, an image forming apparatus according to a first preferred embodiment of the present invention is described. First, the overall configuration of the image forming apparatus 100 according to the first preferred embodiment is described with reference to FIG. 1.

The image forming apparatus 100 includes a body 1. The body 1 defines a body of the image forming apparatus 100. A paper exit tray T is provided on a portion of the body 1. A paper P transported by a paper delivery device 4 (described later) is delivered to the paper exit tray T.

The image forming apparatus 100 includes a paper feed cassette 2. The paper feed cassette 2 is disposed on a lower portion of the body 1 (below an image former 3). Papers P to be transported to the image former 3 for formation of an image are placed in the paper feed cassette 2. The papers P placed on the paper feed cassette 2 are transported to a first transportation path R1 due to the rotation of a pickup roller 21.

The image forming apparatus 100 includes the image former 3 inside the body 1. The image former 3 forms an image on a surface of the paper P transported to the first transportation path R1 by electrophotography. The image former 3, after the image is formed on the paper P, delivers the paper P to a second transportation path R2.

The image forming apparatus 100 includes the paper delivery device 4 inside the body 1 and above the image former 3. The paper delivery device 4 delivers the paper P which is transported through the second transportation path R2 and on which an image is formed to the paper exit tray T through a delivery port E (FIG. 1). The configuration of the paper delivery device 4 is described in detail later. The direction along which the paper P is transported to the paper exit tray T from the delivery port E is referred to as a first direction D1.

The image forming apparatus 100 includes a controller 5 inside the body 1. The controller 5 controls respective elements of the image former 3. The configuration of the controller 5 is described in detail later.

The image forming apparatus 100 includes an operation panel 6 above the body 1. The operation panel 6 includes a touch screen and various types of keys, and receives an input operation performed by a user or the like. The operation panel 6 also includes a display which displays a state of the image forming apparatus 100.

Figure 4:
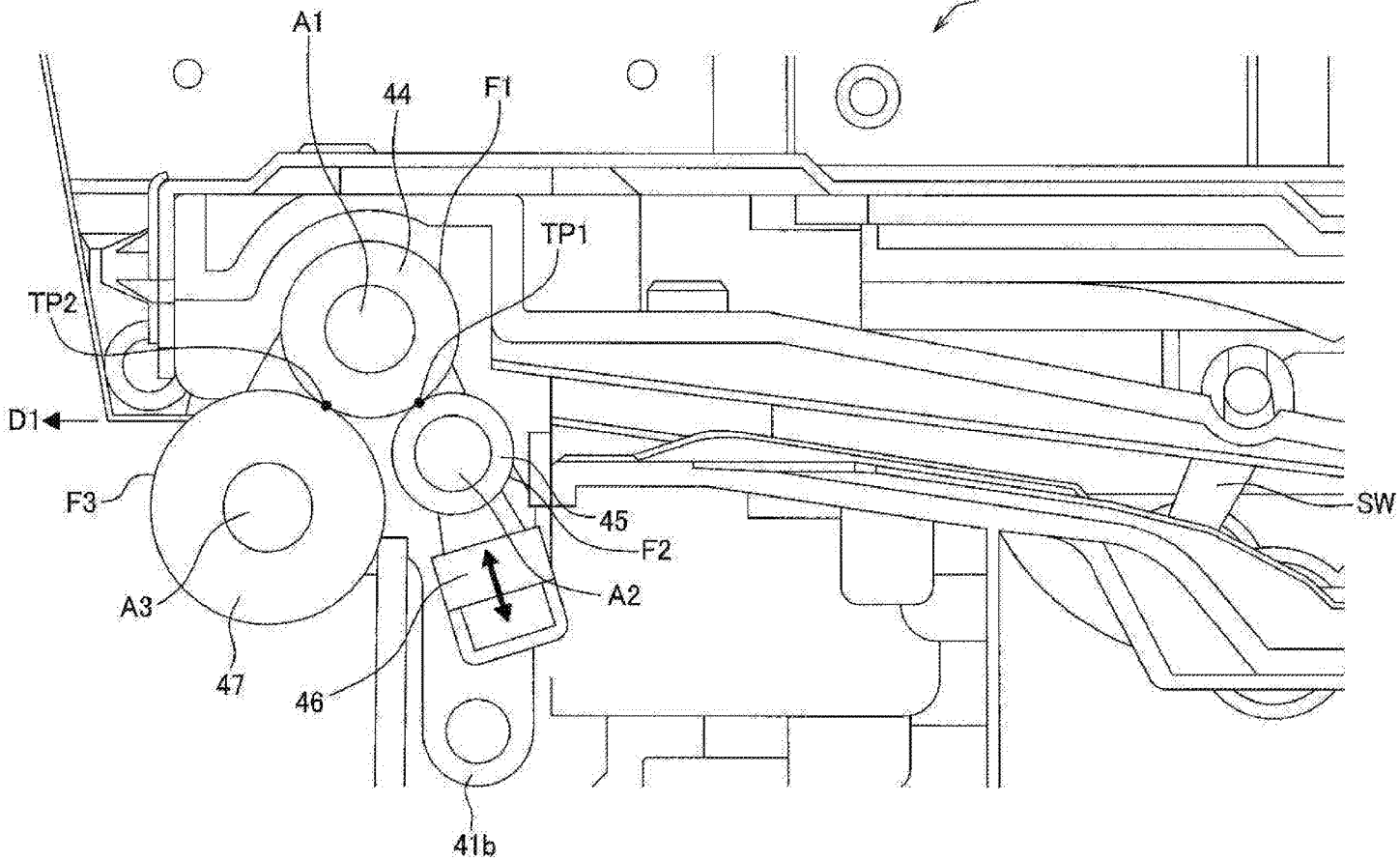
FIG. 4 is a cross-sectional view of the paper delivery device as viewed from a second direction.

The image forming apparatus 100 includes a paper passing detection switch SW in the vicinity of the paper delivery device 4 in the second transportation path R2 (FIG. 4). The paper passing detection switch SW is a switch equipped with a photointerrupter, and detects that the paper P on which an image is formed approaches to the paper delivery device 4.

To be more specific, when a leading edge of the paper P on which an image is formed passes the paper passing detection switch SW, a lever of the paper passing detection switch SW is moved from a position where the lever blocks light to a position where the lever allows passing of the light and hence, passing of the leading edge of the paper P is able to be detected. The paper passing detection switch SW outputs a signal indicative of the reception of the above-mentioned light to the controller 5.

When a rear edge of the paper P passes the paper passing detection switch SW, the lever of the paper passing detection switch SW returns to the position where the lever blocks light from the position where the lever allows passing of the light and hence, it is possible to detect passing of the rear edge of the paper P. The paper passing detection switch SW outputs a signal indicative of the blocking of the above-mentioned light to the controller 5.

That is, the paper passing detection switch SW detects a signal indicative of the detection of light from the photointerrupter of the paper passing detection switch SW and, thereafter, outputs a signal indicative of the blocking of the light (for example, an output signal of the paper passing detection switch SW is switched to an OFF signal from an ON signal) and hence, the paper passing detection switch SW informs the controller 5 of the fact that the rear edge of the paper P in the first direction D1 has passed the paper passing detection switch SW.

The image forming apparatus 100 may include an image reader 7 above the operation panel 6. The image reader 7 is an image scanner, for example, and reads an image from a surface of a document or the like. With such a configuration, the image forming apparatus 100 is able to realize a copying function of forming the image read from the surface of the document on the paper P.

Figure 2:
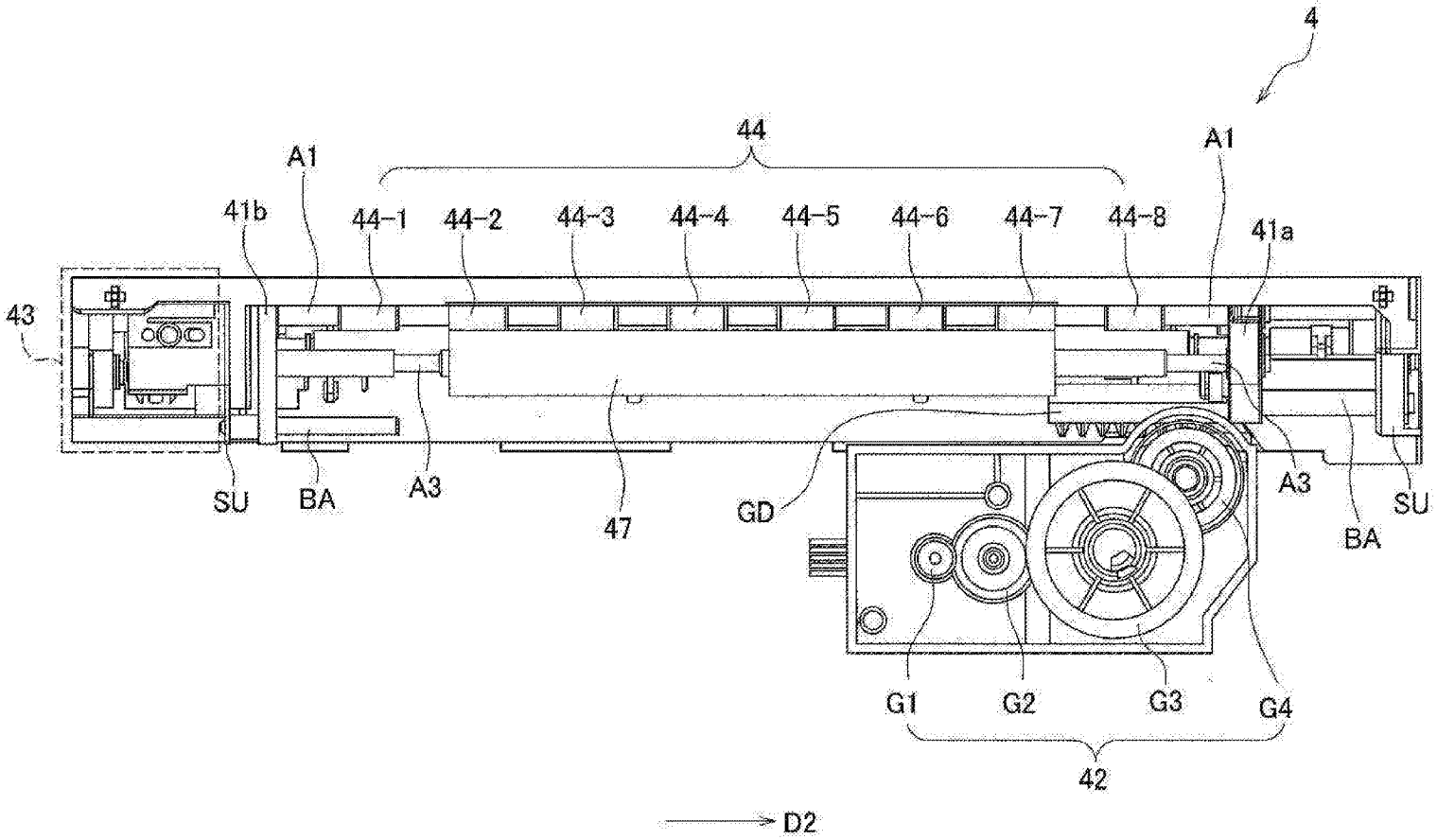
FIG. 2 is a front view of the paper delivery device as viewed from a delivery port.
Figure 3:
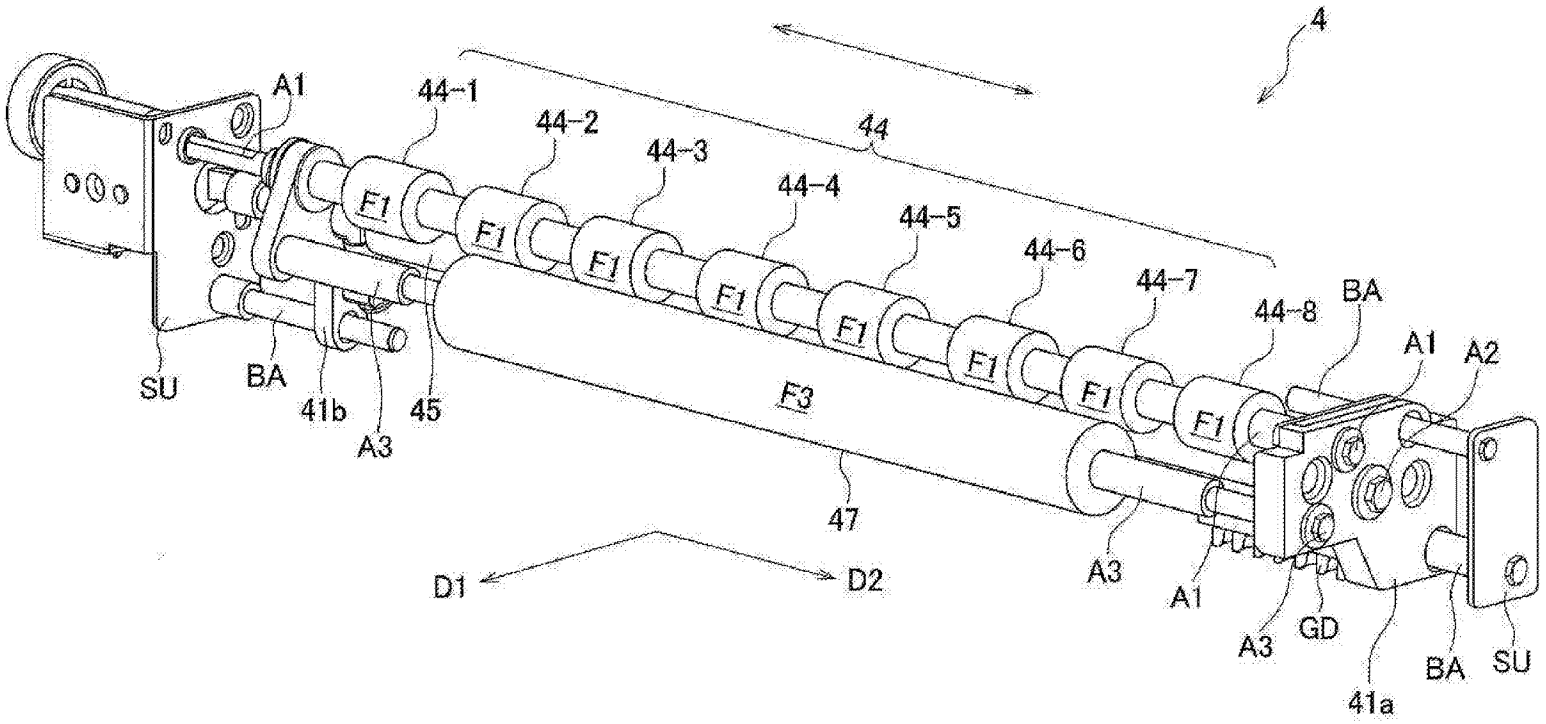
FIG. 3 is a perspective view of the paper delivery device.

Next, the details of the configuration of the paper delivery device 4 are described with reference to FIG. 2, FIG. 3 and FIG. 4. FIG. 2 is a front view of the paper delivery device as viewed from a delivery port. FIG. 3 is a perspective view of the paper delivery device. FIG. 4 is a cross-sectional view of the paper delivery device as viewed from a second direction.

The paper delivery device 4 includes shift frames 41*a*, 41*b*. The shift frames 41*a*, 41*b* are plate-shaped members which are movable in the second direction D2 which is perpendicular or substantially perpendicular to the first direction D1 which is a direction along which the paper P is delivered. To be more specific, each of the shift frames 41*a*, 41*b* is supported by a shift frame support member SU fixed to the inside of the body 1 in a state where rod-shaped members BA which extend in the second direction D2 from the shift frame support member SU penetrate the shift frames 41*a*, 41*b*.

The paper delivery device 4 includes a driver 42. The driver 42 moves the shift frames 41*a*, 41*b* in the second direction D2.

To be more specific, as illustrated in FIG. 2, the driver 42 includes: a first gear G1 connected to an output rotary shaft of a first motor M1 (FIG. 6); a second gear G2 which meshes with the first gear G1 and is axially rotatably supported by the body 1; a third gear G3 which meshes with the second gear G2 and is axially rotatably supported by the body 1; and a fourth gear G4 which meshes with the third gear G3 and is axially rotatably supported by the body 1. The fourth gear G4 meshes with a drive gear GD extending in the second direction D2 from either one of the shift frames (the shift frame 41*a*).

With such a configuration, the shift frames 41*a*, 41*b* are movable in the second direction D2 or in the direction opposite to the second direction D2 due to the rotation of the first motor M1 (FIG. 6) transmitted through the first to fourth gears.

The paper delivery device 4 has a home detector 43. The home detector 43 detects whether or not the shift frames 41*a*, 41*b* are at home positions. The home detector 43 detects whether or not the shift frames 41*a*, 41*b* are at the home positions by a photointerrupter method.

Figure 5A:
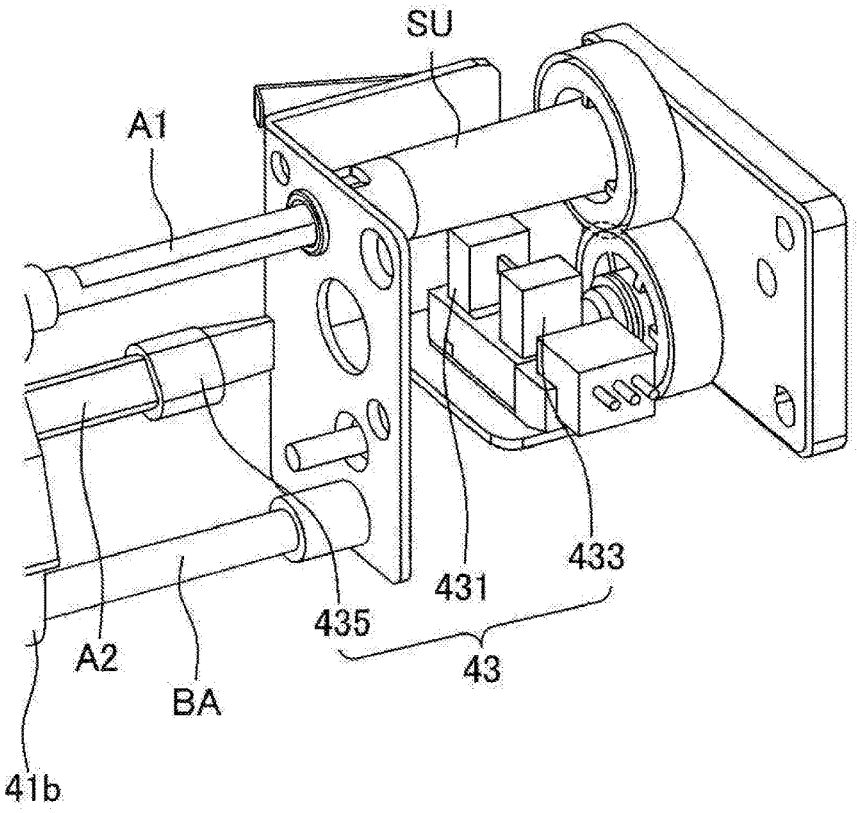
FIG. 5A is a view illustrating a state of a home detector when shift frames are not at home positions
Figure 5B:
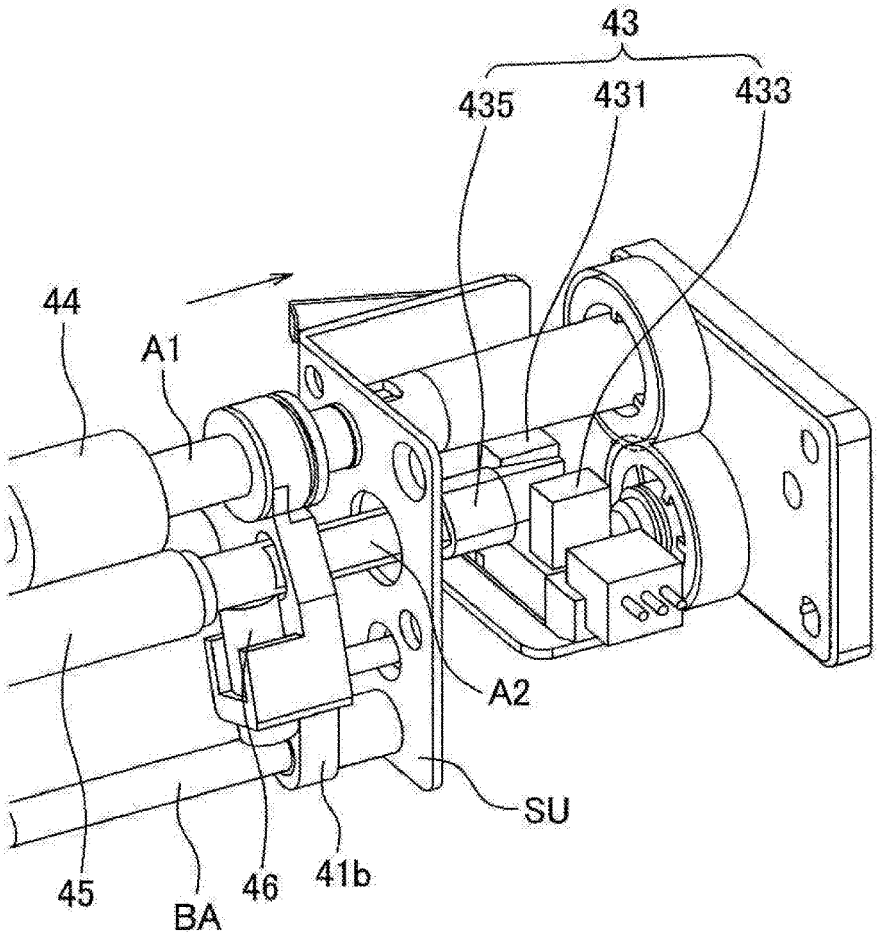
FIG. 5B is a view illustrating the state of the home detector when the shift frames are at the home positions.

To be more specific, as illustrated in FIG. 5A and FIG. 5B, the home detector 43 includes a light source 431. The light source 431 is a light emitting element such as an LED (Light Emitting Diode) which applies light (infrared light, for example) toward a detection element 433 described later.

The home detector 43 includes the detection element 433. The detection element 433 is a photodiode which measures a light reception amount of light from the light source 431. The detection element 433 outputs a detection signal (a voltage value or a current value) indicative of whether or not light is detected to the controller 5 corresponding to intensity of received light.

The home detector 43 includes a blocking member 435. The blocking member 435 is a plate which is mounted on one end on a shift frame 41*b* side of a second shaft A2 (described later) which penetrates a first driven roller 45 (described later). The blocking member 435 moves following the movement of the second shaft A2, and blocks light from the light source 431 or allows the light from the light source 431 to pass therethrough.

Since the home detector 43 has the above configuration, when the shift frames 41*a*, 41*b* are not at the home positions in the second direction D2, as illustrated in FIG. 5A, the home detector 43 is able to detect light from the light source 431 by the detection element 433 and output a signal of a predetermined voltage value or current value to the controller 5. The controller 5 which receives the detection signal is able to determine that the shift frames 41*a*, 41*b* are not at the home positions.

On the other hand, when the shift frames 41*a*, 41*b* are at the home positions in the second direction D2, as illustrated in FIG. 5B, light from the light source 431 is blocked by the blocking member 435. In this case, the detection element 433 does not output the above detection signal of a predetermined voltage value or current value to the controller 5. The controller 5 which does not receive the detection signal is able to determine that the shift frames 41*a*, 41*b* are at the home positions.

FIG. 5A is a view illustrating a state of the home detector when the shift frames are not at the home positions. FIG. 5B is a view illustrating the state of the home detector when the shift frames are at the home positions.

The paper delivery device 4 includes the shift frames 41*a*, 41*b*, the driver 42 and the home detector 43 described above and hence, the paper delivery device 4 is able to deliver the paper P to be delivered to a predetermined position in the second direction D2 in the paper exit tray T.

The paper delivery device 4 includes a drive roller 44. The drive roller 44 includes first outer peripheral surfaces F1 extending in the second direction D2, and is supported by the shift frames 41*a*, 41*b* such that the drive roller 44 is rotatable about a first shaft A1. As illustrated in FIG. 3 and the like, the drive roller 44 includes a plurality of circular columnar rollers 44-1, 44-2, . . . 44-8 made of rubber in which the first shaft A1 penetrates the centers of surfaces of the circular columnar rollers 44-1, 44-2, . . . 44-8 perpendicular or substantially perpendicular to the circular columnar shaft.

Figure 6:
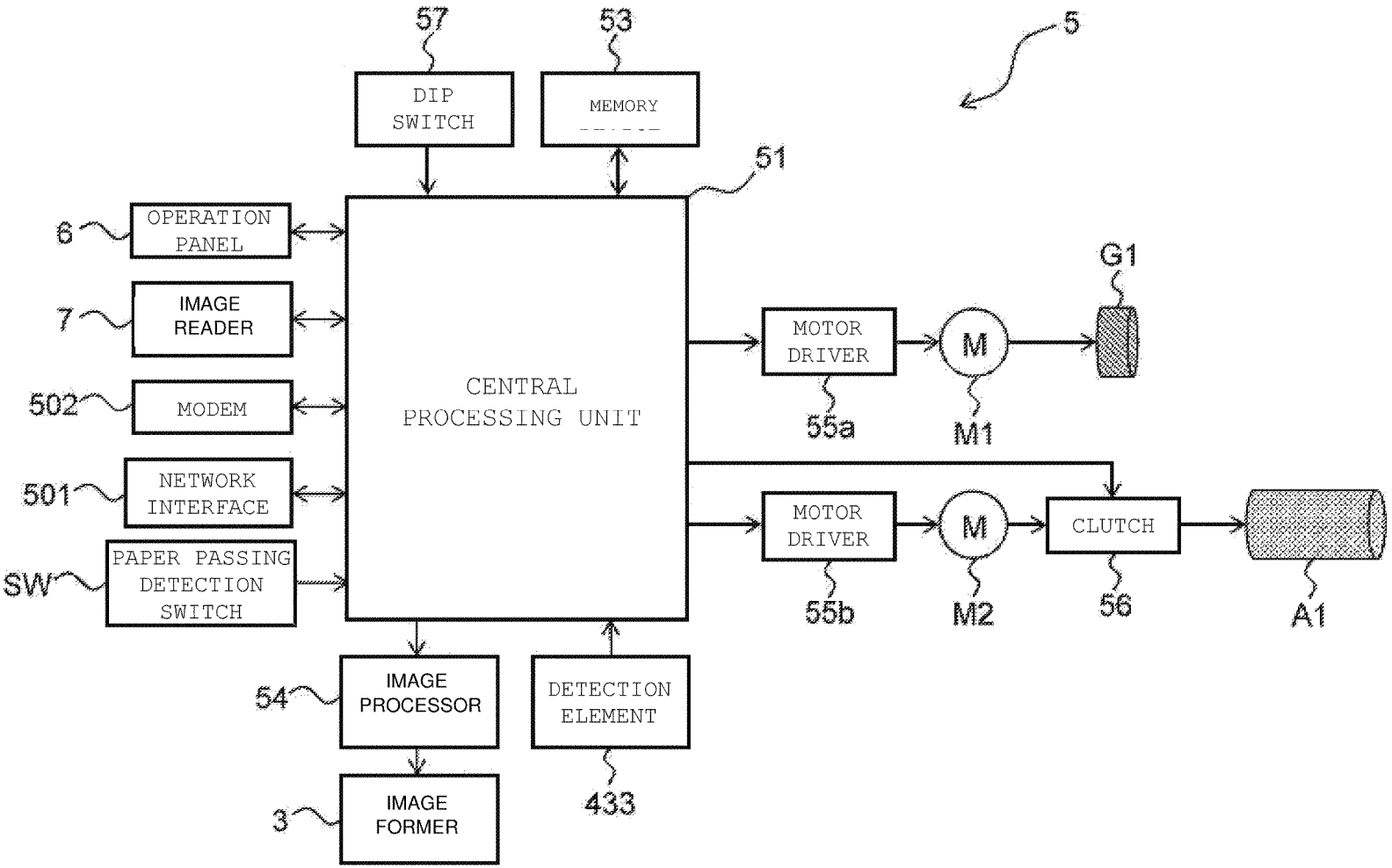
FIG. 6 is a block diagram illustrating the configuration of a controller.

Both ends of the first shaft A1 which penetrate the plurality of rollers 44-1, 44-2, . . . 44-8 are rotatably and pivotally supported by holes or grooves formed in the shift frames 41*a*, 41*b* such that the length direction of the first shaft A1 becomes parallel or substantially parallel to the second direction D2. Either one of ends of the first shaft A1 pivotally supported by the shift frames 41*a*, 41*b* is connected to an output rotary shaft of a second motor M2 (FIG. 6) by way of a clutch 56 (FIG. 6). With such a configuration, the drive roller 44 is rotated about the first shaft A1 due to the rotation of the second motor M2.

The paper delivery device 4 includes the first driven roller 45. The first driven roller 45 extends in the second direction D2, and includes a second outer peripheral surface F2 which is brought into contact with the first outer peripheral surfaces F1 at a first contact position TP1 (FIG. 4). The first driven roller 45 preferably is a resin-made circular cylindrical roller. The first driven roller 45 is supported by the shift frames 41*a*, 41*b* such that the first driven roller 45 is rotatable about the second shaft A2 disposed parallel or substantially parallel to the second direction D2 along with the rotation of the drive roller 44.

To be more specific, the first driven roller 45 is supported by the second shaft A2 such that the first driven roller 45 is rotatable about the second shaft A2. Both ends of the second shaft A2 are supported by the shift frames 41*a*, 41*b* on a side where the second shaft A2 is disposed closer to the second transportation path R2 than the first shaft A1 such that the length direction of the second shaft A2 becomes parallel or substantially parallel to the second direction D2. With such a configuration, a surface (the second outer peripheral surface F2) of the first driven roller 45 which is parallel or substantially parallel to the circular cylindrical shaft is brought into contact with the first outer peripheral surfaces F1 at the first contact position TP1 close to the second transportation path R2 below the drive roller 44 (FIG. 4).

As illustrated in FIG. 4, the first driven roller 45 may be movable relative to the drive roller 44, and may be resiliently biased against the drive roller 44 by a biasing member 46. With such a configuration, for example, when a leading edge of the paper P having a strong curl impinges on the first driven roller 45, the first driven roller 45 is displaced downward so that the leading edge of the paper P is able to be easily introduced between the drive roller 44 and the first driven roller 45.

The paper delivery device 4 includes a second driven roller 47. The second driven roller 47 extends in the second direction D2, and includes a third outer peripheral surface F3 which is brought into contact with the first outer peripheral surfaces F1 at a second contact position TP2 downstream of the first contact position TP1 in the first direction D1. The second driven roller 47 preferably is a circular columnar roller made of foamed plastics having hardness (ASKER C) of 30 degrees. Hardness of the second driven roller 47 is set lower than hardness of the drive roller 44. The second driven roller 47 is supported by the shift frames 41*a*, 41*b* such that the second driven roller 47 is rotatable about a third shaft A3 disposed parallel or substantially parallel to the second direction D2 along with the rotation of the drive roller 44.

To be more specific, the third shaft A3 penetrates the center of a surface of the second driven roller 47 perpendicular or substantially perpendicular to the circular columnar shaft such that the second driven roller 47 is rotatable about the third shaft A3. Both ends of the third shaft A3 are supported by the shift frames 41*a*, 41*b* at a position closer to the delivery port E (FIG. 1) than the second shaft A2 such that the length direction of the third shaft A3 becomes parallel or substantially parallel to the second direction D2. With such a configuration, a surface of the second driven roller 47 parallel or substantially parallel to the circular columnar shaft (the third outer peripheral surface F3) is brought into contact with the first outer peripheral surface F1 at the second contact position TP2 with a predetermined contact force.

The second driven roller 47 preferably is made of sponge having the above hardness and hence, the second driven roller 47 is resiliently deformed corresponding to a thickness of the paper P and the paper P is able to be nipped with a fixed nipping force regardless of a kind of the paper P.

Further, unlike the first driven roller 45, the second driven roller 47 may be supported by the shift frames 41*a*, 41*b* such that the second driven roller 47 is not movable relative to the drive roller 44. That is, an inter-shaft distance between the first shaft A1 of the drive roller 44 and the third shaft A3 of the second driven roller 47 is fixed. With such a configuration, there is no possibility that a nipping force generated by the second driven roller 47 is weakened or strengthened depending on a thickness of the paper P. As a result, the second driven roller 47 is able to nip the paper P with a fixed or uniform nipping force regardless of a kind of the paper P.

The paper delivery device 4 includes the drive roller 44, the first driven roller 45 and the second driven roller 47 described above. Accordingly, at the time of delivering the paper P to the paper exit tray T due to the rotation of three rollers, it is possible to bend the paper P nipped by three rollers in the direction opposite to the direction of curl generated on the paper P. As a result, curl generated on the paper P is able to be significantly reduced or eliminated.

Further, as described above, the drive roller 44, the first driven roller 45 and the second driven roller 47 are supported by the shift frames 41*a*, 41*b* which are movable in the second direction D2. With such a configuration, it is possible to realize the compact paper delivery device 4 that performs both a shift sorting function and a decurling function. As a result, a volume of the body 1 is able to be decreased thus realizing the downsizing of the image forming apparatus 100.

Next, the configuration of the controller 5 which controls respective elements of the image forming apparatus 100 is described with reference to FIG. 6. FIG. 6 illustrates the configuration of the controller. The controller 5 includes a central processing unit (CPU) 51. The central processing unit 51 preferably is a system on chip in which an information processing circuit, a signal processing circuit (an analog to digital converter, a digital to analog converter) or the like, a communication circuit and the like are preferably formed as one chip.

The central processing unit 51 performs information processing to operate respective elements of the controller 5 based on an instruction from a user received by the operation panel 6, an instruction from a computer (not illustrated in the drawing) which is connected to the image forming apparatus 100 through a network interface 501 such as an Ethernet (registered trademark) card. The central processing unit 51 outputs a signal including information related to a state of the image forming apparatus 100 to the operation panel 6 or the above computer.

Further, the central processing unit (CPU) 51 receives inputting of image data from the image reader 7, the network interface 501 and a modem 502, and outputs the image data to an image processor 54 (described later).

The controller 5 includes a memory 53. The memory 53 is a device which stores information, such as a RAM (Random Access Memory), a ROM (Read Only Memory) or an HDD (Hard Disk Drive). The memory 53 stores various settings of the image forming apparatus 100, programs executed by the central processing unit 51 and the like.

The controller 5 includes the image processor 54. The image processor 54 controls the image former 3 based on image data input to the image processor 54 from the image reader 7 or the like through the central processing unit 51. The above functions of the image processor 54 are preferably realized on hardware by an FPGA (Field Programmable Gate Array).

The controller 5 includes motor drivers 55*a*, 55*b*. The motor drivers 55*a*, 55*b* are motor control circuits which respectively output drive signals generated based on pulse signals output from the central processing unit 51 to the first motor M1 and the second motor M2 (stepping motors), and control the rotation of these motors.

The controller 5 includes the clutch 56. The clutch 56, based on an instruction from the central processing unit 51, for example, transmits the rotation of the second motor M2 to the first shaft A1 or interrupts the transmission of the rotation by making the gear which is connected to a rotation transmission mechanism (not illustrated in the drawing) from the second motor M2 and the gear which is connected to the first shaft A1 mesh with each other or by separating these gears from each other.

The controller 5 includes a DIP switch 57. The DIP switch 57 includes a plurality of switches. The DIP switch 57 sets a transportation time from a point of time when a rear edge of the paper P reaches the paper delivery device 4 to a point of time when only the rear edge of the paper P is nipped at the second contact position TP2 due to the combination of ON and OFF of the plurality of switches. To be more specific, the transportation time is calculated by the central processing unit 51 as a product of a binary numerical value and a unit time expressed as combination of ON and OFF of the plurality of switches of the DIP switch 57. The above unit time is stored in the memory 53.

The DIP switch 57 is not limited to a hardware DIP switch and may be a so-called software DIP switch. In this case, a set value of the DIP switch 57 is held in a non-volatile memory (for example, the memory 53). For example, binary expressed values where ON of the DIP switch is set as "1" and OFF of the DIP switch is set as "0" can be stored in the memory 53. Besides the above values, values which are obtained by converting binary expressed value based on ON/OFF of the DIP switch into decimal numbers or hexadecimal numbers can be stored in the memory 53.

By changing the combination of ON and OFF of switches of the DIP switch 57, that is, by changing magnitude of a numerical value set by the DIP switch 57 corresponding to a state of the image forming apparatus 100 or the like, a transportation time until only a rear edge of the paper P is nipped only at the second contact position TP2 is able to be arbitrarily set.

The above transportation time can be preliminarily decided as a time slightly shorter than a time from a point of time when a rear edge of the paper P passes a mounting position of the paper passing detection switch SW to a point of time when the rear edge of the paper P reaches the second contact position TP2, for example.

Figure 7:
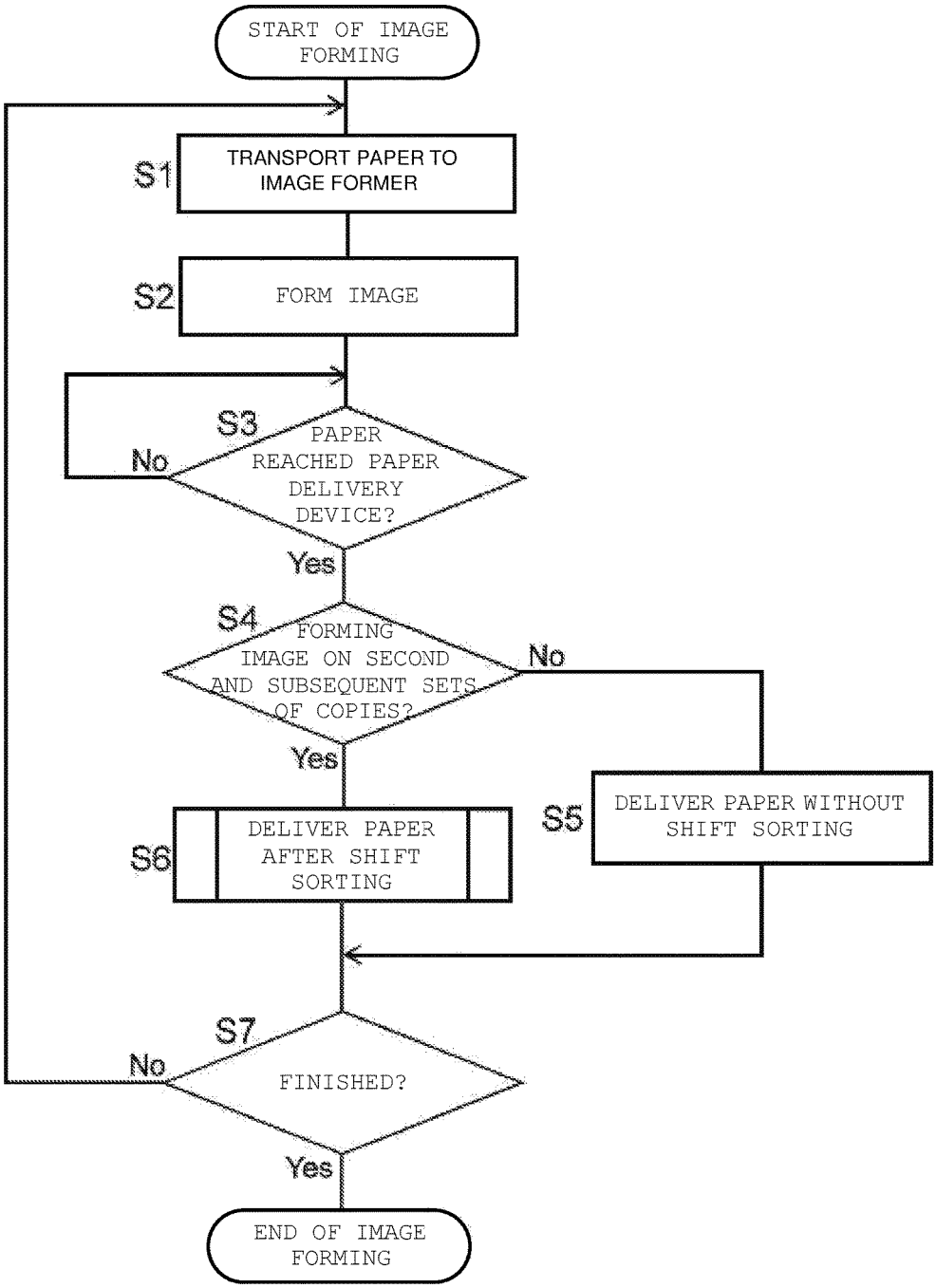
FIG. 7 is a flowchart illustrating an image forming process of the image forming apparatus.

Next, an operation of delivering the paper P on which an image is formed to the paper exit tray T in the image forming apparatus 100 is described with reference to FIG. 7. FIG. 7 is a flow chart illustrating an image forming process of the image forming apparatus.

In the following description, an image forming process is described by taking a case where the image formation of a plurality of copies is performed as an example. Further, in performing the image formation of the plurality of copies, it is assumed that second and subsequent sets of copies are delivered to the paper exit tray T after the papers P are shifted and sorted. Further, it is assumed that the shift frames 41*a*, 41*b* are at the home positions at the time of starting the image forming process.

When an instruction to form an image on the paper P is issued through an operation of the operation panel 6, communication from an external computer through the network interface 501 or the like, the central processing unit 51 rotates the pickup roller 21. Accordingly, the papers P placed on the paper feed cassette 2 are transported to the image former 3 through the first transportation path R1 (step S1).

When the paper P is transported to the image former 3, the formation of an image on the paper P is started (step S2). To be more specific, first, the central processing unit 51 transmits image data received from the image reader 7 or the modem 502 or image data received from the external computer or the like through the network interface 501 to the image processor 54.

Next, the image processor 54 which receives image data applies light on a surface of a charged photoconductive drum 32 (FIG. 1) based on a gradation value of the received image data or the like while controlling a light quantity of a light source 31 (FIG. 1) of the image former 3. As a result, an electrostatic latent image which corresponds to the received image data is formed on a surface of the photoconductive drum 32.

Then, a toner feeder 33 (FIG. 1) feeds toner to the photoconductive drum 32 on which the electrostatic latent image is formed. Accordingly, toner is adhered to the surface of the photoconductive drum 32 corresponding to the electrostatic latent image. Then, during the passing of the transported paper P on the surface of the photoconductive drum 32, toner adhered to the photoconductive drum 32 is transferred to one surface of the paper P.

After the toner is transferred to the paper P, the surface of the paper P to which the toner is transferred is heated by a heater roller 34 (FIG. 1) and, at the same time, a pressure is applied to the surface by a press roller 35 (FIG. 1). Accordingly, the toner is fused to the paper P. That is, an image corresponding to image data is formed on the paper P.

In fusing the toner to the paper P, moisture evaporates from a surface of the paper P on a heater roller 34 side. Due to the evaporation of moisture from the paper P, the heated surface of the paper P is shrunken first. As a result, there may be a case where the paper P is curled such that a surface of the paper P on which the image is formed by fusing the toner is disposed inside. With respect to curl of the paper P which is generated in the toner fusing step, curl which is generated such that the surface of the paper P on which the image is formed by fusing becomes the inside (concave surface) is referred to as image curl.

After an image is formed on the paper P, the central processing unit 51 determines whether or not the paper P on which the image is formed is transported through the second transportation path R2 and reaches the paper delivery device 4 (step S3).

To be more specific, the central processing unit 51 determines that a leading edge of the paper P has reached the paper delivery device 4 when the central processing unit 51 receives a detection signal indicative of the detection of light of the photointerrupter of the paper passing detection switch SW.

When the central processing unit 51 determines that the paper P has not reached the paper delivery device 4 ("No" in step S3), the central processing unit 51 stands by until the central processing unit 51 receives the above detection signal from the paper passing detection switch SW.

On the other hand, when the central processing unit 51 determines that the paper P has reached the paper delivery device 4 ("Yes" in step S3), the central processing unit 51 delivers the paper P on which the image is formed to a predetermined position of the paper exit tray T.

Before starting an operation of delivering the paper P to the paper exit tray T, the central processing unit 51 determines whether the paper P is to be delivered after the paper P is moved (shift sorting) in the second direction D2 or the paper P is delivered without performing shift sorting (step S4).

To be more specific, in the case where the image formation of the plurality of sets of copies is instructed and shift sorting is also instructed, when the formation of the image for second or subsequent set of copies is performed in the image forming process, the central processing unit 51 determines that shift sorting of the papers P is necessary.

When the formation of the image for the first set of copies is being performed at that moment and the central processing unit 51 determines that shift sorting of the paper P is unnecessary ("No" in step S4), the central processing unit 51 delivers the paper P to the paper exit tray T without performing shift sorting of the paper P (step S5).

To be more specific, the central processing unit 51 issues an instruction to the clutch 56 requesting that the rotation of the second motor M2 be transmitted to the first shaft A1 so that the drive roller 44 is rotated. When the rotation of the drive roller 44 is started, the rotation of the first driven roller 45 and the rotation of the second driven roller 47 are started along with the rotation of the drive roller 44.

When the paper P is transported to the first contact position TP1 of the paper delivery device 4, the paper P is nipped between the first outer peripheral surfaces F1 of the drive roller 44 and the second outer peripheral surface F2 of the first driven roller 45.

Figure 8:
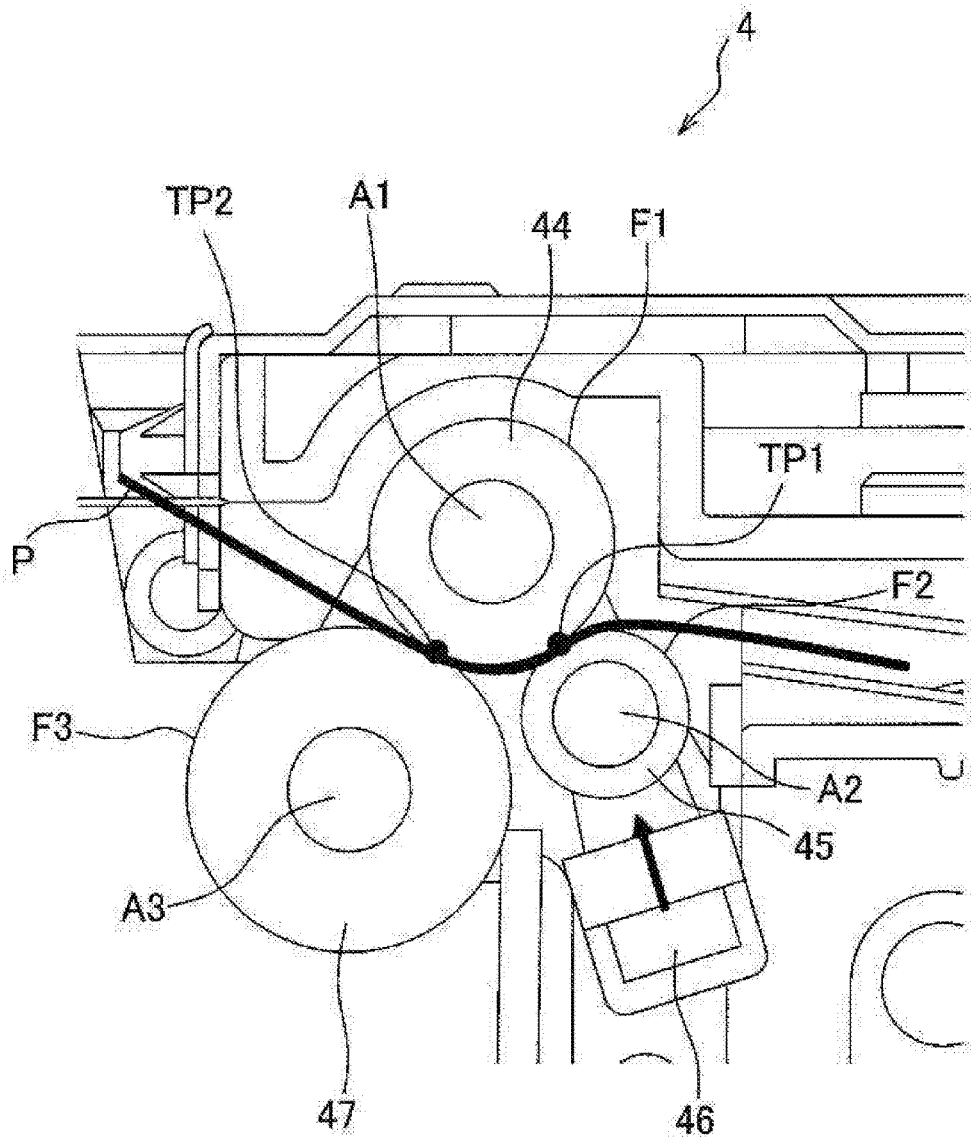
FIG. 8 is a view illustrating a state where a sheet of paper is nipped by three rollers.

Then, due to the rotation of the drive roller 44 and the rotation of the first driven roller 45, the paper P is transported to the second contact position TP2 of the paper delivery device 4. When the paper P reaches the second contact position TP2, as illustrated in FIG. 8, the paper P is nipped at the first contact position TP1 and, at the same time, the paper P is nipped between the first outer peripheral surfaces F1 of the drive roller 44 and the third outer peripheral surface F3 of the second driven roller 47 at the second contact position TP2. FIG. 8 illustrates a state where the paper is nipped by three rollers.

When the paper P is nipped at two positions, that is, at the first contact position TP1 and the second contact position TP2, as illustrated in FIG. 8, the paper P is disposed such that a surface of the paper P on a side opposite to the surface of the paper P on which the image is formed (an upper-side surface of the paper P in FIG. 8) is disposed along a curve of the first outer peripheral surfaces F1 of the drive roller 44. That is, the paper P nipped by three rollers is curved in the direction opposite to the direction of image curl. By bending the paper P in the direction opposite to the direction of image curl, three rollers are able to eliminate image curl generated on the paper P.

The paper P from which image curl is eliminated is transported in the first direction D1 due to the rotation of the drive roller 44, the first driven roller 45 and the second driven roller 47, and is delivered to the paper exit tray T from the delivery port E.

Figure 9:
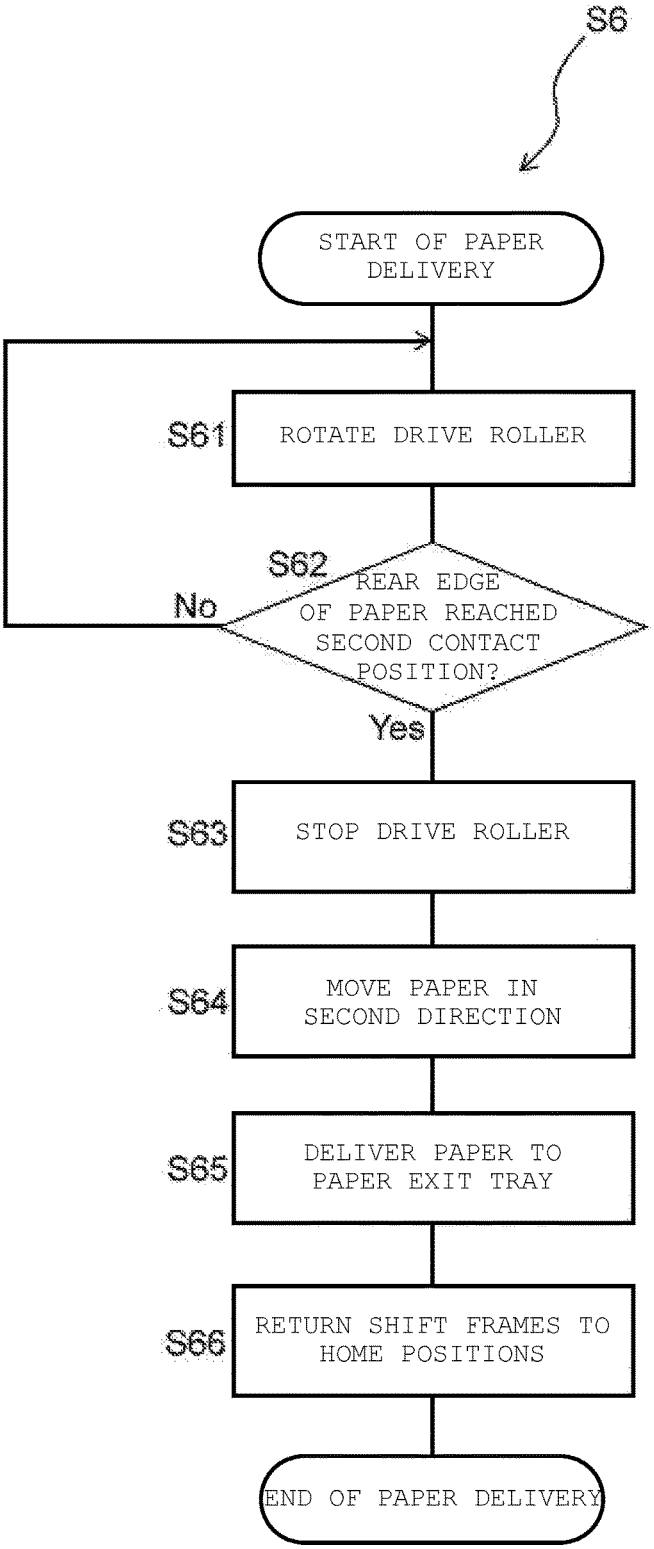
FIG. 9 is a flow chart illustrating a process in which a paper is delivered after performing shift sorting.

On the other hand, when the formation of the image for second or subsequent set of copies is being performed at that moment and the central processing unit 51 determines that shift sorting of the papers P is necessary ("Yes" in step S4), the central processing unit 51 delivers the paper P to the paper exit tray T after performing shift sorting of the paper P (step S6). To be more specific, the paper P is delivered in accordance with the flow of processing illustrated in the flow chart in FIG. 9.

First, the central processing unit 51 issues an instruction to the clutch 56 requesting that the rotation of the second motor M2 be transmitted to the first shaft A1 so that the drive roller 44 is rotated (step S61). With such a step, as described above, the paper P on which an image is formed is transported in the first direction D1 by the drive roller 44, the first driven roller 45 and the second driven roller 47. During the transportation of the paper P in the first direction D1, the paper P is nipped by the above three rollers and hence, image curl generated on the paper P is eliminated.

During the transportation of the paper P in the first direction D1, the central processing unit 51 determines whether or not the rear edge of the paper P in the first direction D1 has reached the second contact position TP2 (step S62).

To be more specific, the central processing unit 51 determines that the rear edge of the paper P in the first direction D1 has reached the second contact position TP2 when a time which has elapsed from a point of time when the rear edge portion of the paper P has passed the paper passing detection switch SW becomes a transportation time set by the DIP switch 57.

When the central processing unit 51 determines that the rear edge of the paper P has not reached the second contact position TP2 ("No" in step S62), the processing to deliver the paper P after performing shift sorting of the paper P returns to step S61. That is, the central processing unit 51 continues the rotation of the drive roller 44.

On the other hand, when the central processing unit 51 determines that the rear edge of the paper P has reached the second contact position TP2 ("Yes" in step S62), the central processing unit 51 issues an instruction to the clutch 56 requesting that an output rotary shaft of the second motor M2 and the first shaft A1 be interrupted from each other so that the rotation of the drive roller 44 is stopped (step S63).

Figure 10:
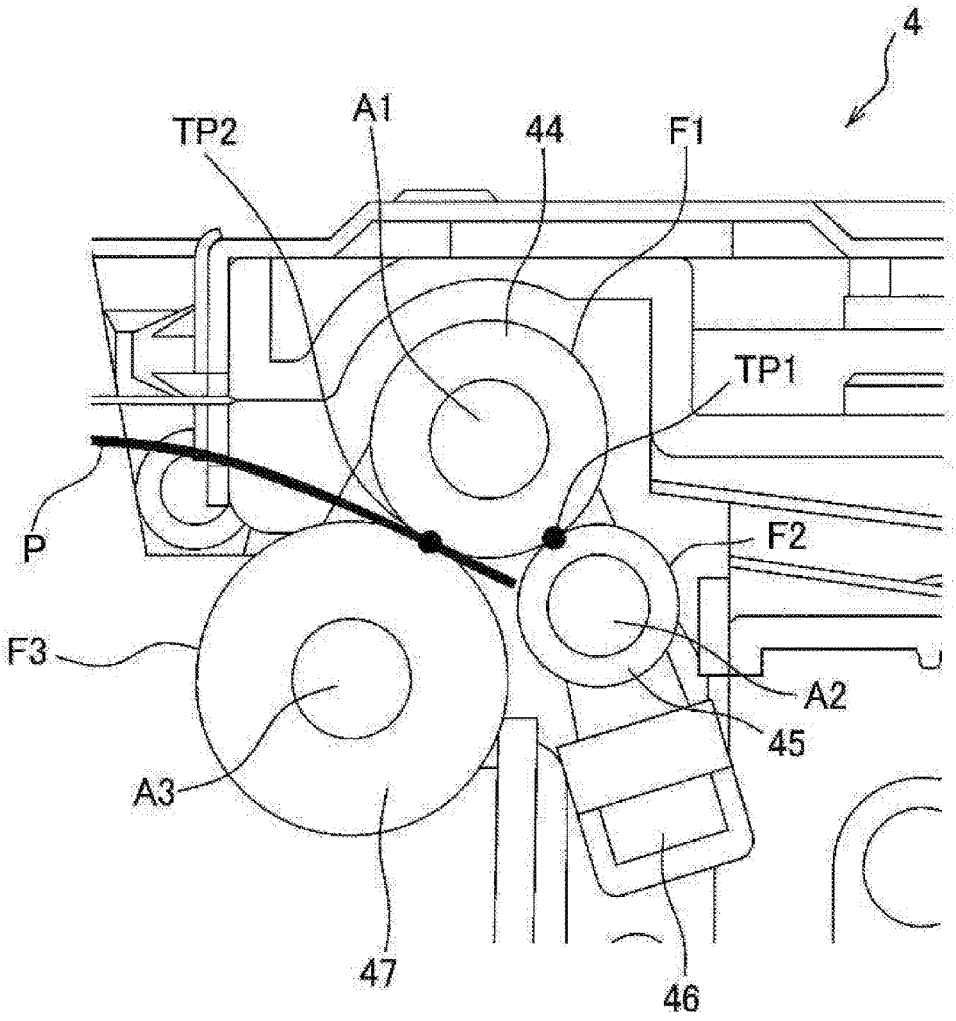
FIG. 10 is a view illustrating a state where a rear edge of the paper is nipped at a second contact position.

By stopping the rotation of the drive roller 44 when the rear edge of the paper P has reached at the second contact position TP2, as illustrated in FIG. 10, the rear edge of the paper P in the first direction D1 is released from nipping between the first outer peripheral surfaces F1 and the second outer peripheral surface F2 and hence, the rear edge of the paper P in the first direction D1 is nipped only between the first outer peripheral surfaces F1 and the third outer peripheral surface F3. FIG. 10 illustrates a state where the rear edge of the paper is nipped at the second contact position. As illustrated in FIG. 10, the rotation of the drive roller 44 is stopped in a state where the rear edge of the paper P is nipped only at the second contact position TP2 and hence, it is possible to prevent the occurrence of nip marks on the rear edge of the paper P.

Thereafter, the paper P is moved to a different position in the second direction D2 (step S64).

To be more specific, the central processing unit 51 issues an instruction to the first motor M1 requesting that the first gear G1 be rotated in the rotating direction so that the shift frames 41*a*, 41*b* are moved in the direction away from the home positions in the second direction D2. Thereafter, the central processing unit 51 outputs a pulse signal having a predetermined number of pulses to a motor driver 55*a* which drives the first motor M1.

The above number of pulses of the pulse signal which is output to the motor driver 55*a* is decided based on the position in the second direction D2 in the paper exit tray T to which the paper P is delivered, for example, the number of the set of copies which is under a copying operation at that moment.

Figure 11:
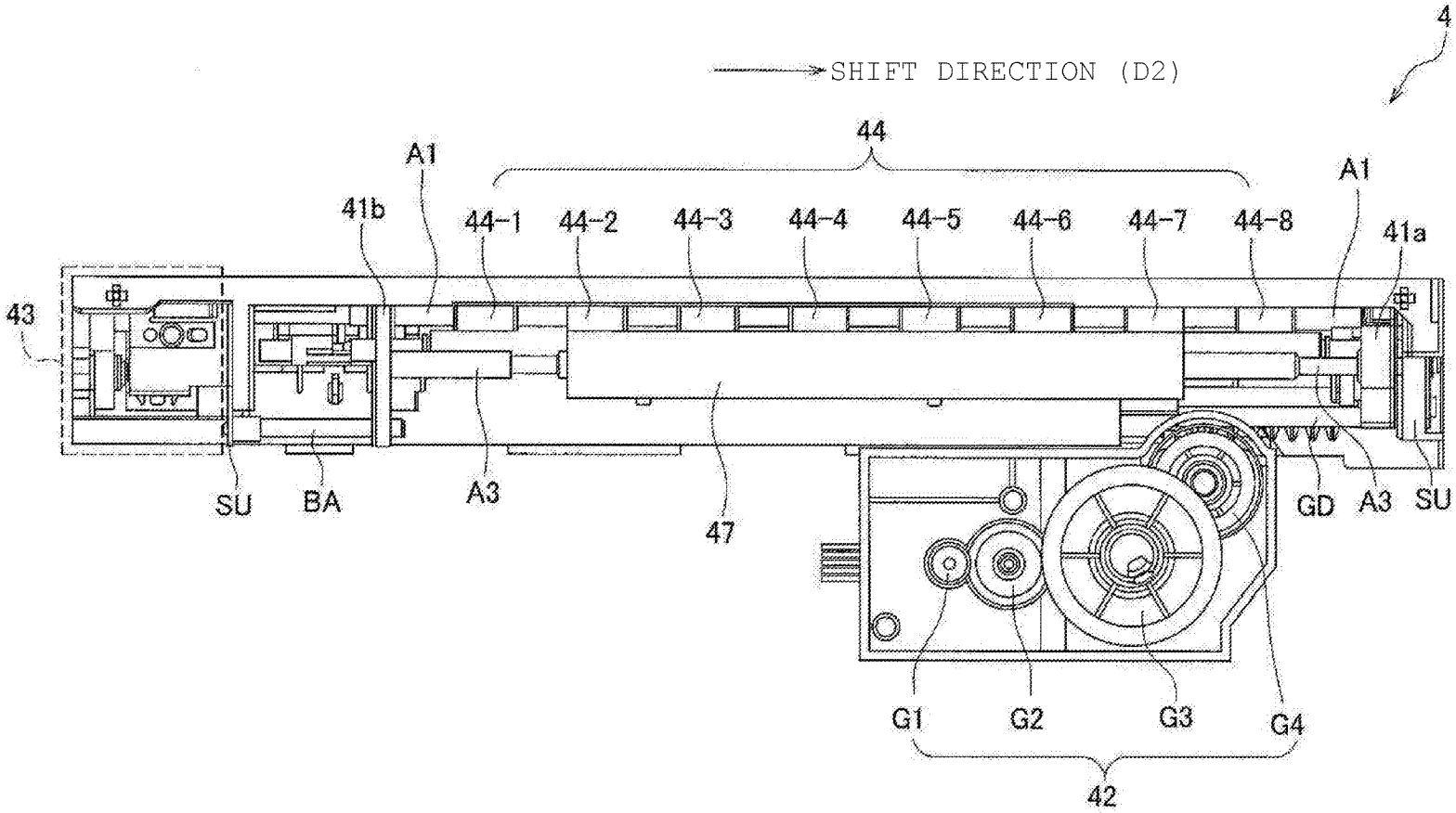
FIG. 11 is a view illustrating one example of a state of the paper delivery device where the shift frame is shifted in the second direction from the home position.

By performing step S64, as illustrated in FIG. 11, the shift frames 41*a*, 41*b* are moved in the second direction D2 from the home positions by an amount of movement corresponding to the above number of pulses of a pulse signal output from the central processing unit 51 due to the rotation of the first motor M1. That is, the paper P is moved to the position in the second direction D2 corresponding to the number of pulses of the pulse signal output from the central processing unit 51. FIG. 11 illustrates one example of a state of the paper delivery device where the shift frame is shifted in the second direction from the home position.

During the movement of the paper P in the second direction D2 by performing step S64, the rear edge of the paper P in the first direction D1 is nipped only at the second contact position TP2. That is, during the movement of the paper P in the second direction D2, the paper P is not brought into a state where the paper P is curved by nipping by three rollers. Accordingly, it is possible to avoid the occurrence of nip marks on the paper P during the movement of the paper P in the second direction D2.

After the paper P is moved to the predetermined position in the second direction D2, the paper P is delivered to the paper exit tray T (step S65). To be more specific, the central processing unit 51 issues an instruction to the clutch 56 requesting that the rotation of the second motor M2 be transmitted to the first shaft A1 by a time (stored in the memory 53) which is preset based on a transportation speed of the paper P and a transportation distance along which the paper P is delivered. Accordingly, the rear edge of the paper P in the first direction D1 is released from nipping between the first outer peripheral surfaces F1 and the third outer peripheral surface F3, and the paper P is delivered to the paper exit tray T from the delivery port E.

After the paper P is delivered to the paper exit tray T, the central processing unit 51 returns the shift frames 41*a*, 41*b* to the home positions (step S66).

To be more specific, first, the central processing unit 51 issues an instruction to the first motor M1 requesting that the first gear G1 be rotated in the rotating direction so that the shift frames 41*a*, 41*b* are moved in the direction opposite to the direction away from the home positions in the second direction D2.

Thereafter, the central processing unit 51 outputs a pulse signal to drive the first motor M1 to the motor driver 55*a* until the central processing unit 51 no longer receives a detection signal having a predetermined voltage value or current value from the detection element 433 of the home detector 43. Accordingly, the shift frames 41*a*, 41*b* are moved to the home positions from the present positions due to the rotation of the first motor M1.

As described above, in step S66, the home detector 43 detects whether or not the shift frames 41*a*, 41*b* have reached the home position. Accordingly, the central processing unit 51 is able to detect with certainty that the shift frames 41*a*, 41*b* have returned to the home positions. As a result, the central processing unit 51 is able to stop the rotation of the first motor M1 with proper timing at the time of returning the shift frames 41*a*, 41*b* to the home positions.

After a sheet of the paper P is delivered to the paper exit tray T by performing step S5 or step S6, the central processing unit 51 determines whether or not image forming process is to be finished (step S7). To be more specific, when the central processing unit 51 determines that steps S1 to S6 are repeatedly performed the number of times corresponding to a product of the instructed number of sets of copies and the number of pages per one copy, the central processing unit 51 determines that the image forming process is to be finished.

When the central processing unit 51 determines that the image forming process is not to be finished ("No" in step S7), the image forming process returns to step S1. That is, steps S1 to S6 are repeatedly performed the number of times corresponding to a product of the instructed number of sets of copies and the number of pages per one copy. On the other hand, when the central processing unit 51 determines that the steps S1 to S6 are performed corresponding to the instructed number of sets of copies and the image forming process is to be finished ("Yes" in step S7), the central processing unit 51 finishes the image forming process.

The above paper delivery device according to the first preferred embodiment preferably has the following configurations and functions.

The paper delivery device (for example, the paper delivery device 4) is provided in an image forming apparatus (for example, the image forming apparatus 100) to form an image on a paper (for example, the paper P), and delivers the paper on which an image is formed to an outside (for example, the paper exit tray T). The paper delivery device includes the shift frames (for example, the shift frames 41*a*, 41*b*), the driver (for example, the driver 42), the drive roller (for example, the drive roller 44), the first driven roller (for example, the first driven roller 45), and the second driven roller (for example, the second driven roller 47).

The shift frame is movable in the second direction (for example, the second direction D2) perpendicular or substantially perpendicular to the first direction (for example, the first direction D1) along which the paper is delivered to the outside. The driver moves the shift frame in the second direction.

The drive roller includes the first outer peripheral surface (for example, the first outer peripheral surfaces F1) extending in the second direction, and is rotatable about the first shaft (for example, the first shaft A1) disposed parallel or substantially parallel to the second direction.

The first driven roller includes the second outer peripheral surface (for example, the second outer peripheral surface F2) which extends in the second direction and is brought into contact with the first outer peripheral surface at the first contact position (for example, the first contact position TP1). The first driven roller is supported by the shift frames such that the first driven roller is rotatable about a second shaft (for example, the second shaft A2) disposed parallel or substantially parallel to the second direction following the rotation of the drive roller. The first driven roller is rotated in a state where the paper is nipped between the first outer peripheral surfaces and the second outer peripheral surface thus transporting the paper in the first direction.

The second driven roller includes the third outer peripheral surface (for example, the third outer peripheral surface F3) which extends in the second direction and is brought into contact with the first outer peripheral surfaces at the second contact position (for example, the second contact position TP2) downstream of the first contact position in the first direction. The second driven roller is supported by the shift frame such that the second driven roller is rotated about the third shaft (for example, the third shaft A3) disposed parallel or substantially parallel to the second direction following the rotation of the drive roller. The second driven roller is rotated in a state where the paper which is nipped between the first outer peripheral surfaces and the second outer peripheral surface is nipped between the first outer peripheral surface and the third outer peripheral surface thus transporting the paper in the first direction.

Other Preferred Embodiments

Although preferred embodiments of the present invention have been described heretofore, the present invention is not limited to the above preferred embodiments, and various modifications are conceivable without departing from the gist of the present invention. Particularly, a plurality of preferred embodiments and modifications described in this specification may be arbitrarily combined with each other when necessary.

In the above first preferred embodiment, the DIP switch 57 preferably sets a time from a point of time when passing of the rear edge of the paper P on the paper passing detection switch SW is detected to a point of time when only the rear edge of the paper P in the first direction D1 is nipped only at the second contact position TP2.

However, it is sufficient for the DIP switch 57 to set an amount of rotation of the second motor M2 corresponding to a transportation distance of the paper P necessary for allowing nipping of only the rear edge of the paper P in the first direction D1 only at the second contact position TP2 after the paper P reaches the paper delivery device 4 and hence, a set value set by the DIP switch 57 is not limited to the above-mentioned time.

For example, the DIP switch 57 may set the number of pulses of a pulse signal which the central processing unit 51 outputs to the motor driver 55*b* and which is necessary to nip only the rear edge of the paper P in the first direction D1 at only the second contact position TP2 after the paper P reaches at the paper delivery device 4.

In this case, the central processing unit 51 may issue an instruction to the clutch 56 requesting that the rotation of the second motor M2 be not transmitted to the first shaft A1 at a timing that the number of pulses of a pulse signal output to the motor driver 55*b* becomes a value set by the DIP switch 57.

In the above first preferred embodiment, all of the plurality of small rollers 44-1, 44-2, . . . 44-8 of the drive roller 44 preferably have the same length in the second direction D2. However, the drive roller 44 is not limited to such a configuration. To enable stable nipping of an end portion of the paper P in the second direction D2, among the plurality of small rollers 44-1, 44-2, . . . 44-8, the length in the second direction D2 of the small rollers 44-1, 44-8 which form end portions of the drive roller 44 in the second direction D2 may be set larger than the length in the second direction D2 of other small rollers 44-2, 44-3, . . . 44-7.

In the above first preferred embodiment, nothing is disposed in a gap between the first driven roller 45 and the second driven roller 47. However, the present invention is not limited to such a configuration. For example, a belt having a predetermined width with respect to the second direction D2 may be arranged such that the belt extends between and over the first driven roller 45 and the second driven roller 47.

With such a configuration, the paper P nipped at the first contact position TP1 is able to be moved to the second contact position TP2 with certainty without being moved in the direction which differs from the direction along which the paper P is transported to the second contact position TP2. As a result, the paper P is able to be nipped with certainty at the second contact position TP2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A paper delivery device provided in an image forming apparatus to form an image on a paper and deliver the paper on which an image is formed to an outside, the paper delivery device comprising:

a shift frame which is movable in a second direction perpendicular or substantially perpendicular to a first direction along which the paper is delivered to the outside;

a driver that moves the shift frame in the second direction;

a drive roller that includes a first outer peripheral surface extending in the second direction and is supported by the shift frame such that the drive roller is rotatable about a first shaft disposed parallel or substantially parallel to the second direction;

a first driven roller including a second outer peripheral surface which extends in the second direction and is brought into contact with the first outer peripheral surface at a first contact position, the first driven roller being supported by the shift frame such that the first driven roller is rotatable about a second shaft disposed parallel or substantially parallel to the second direction following the rotation of the drive roller, the first driven roller is rotatable in a state where the paper is nipped between the first outer peripheral surface and the second outer peripheral surface thus transporting the paper in the first direction;

a second driven roller including a third outer peripheral surface which extends in the second direction and is brought into contact with the first outer peripheral surface at a second contact position downstream of the first contact position in the first direction, the second driven roller being supported by the shift frame such that the second driven roller is rotatable about a third shaft parallel or substantially parallel to the second direction following the rotation of the drive roller, the second driven roller being rotatable in a state where the paper which is nipped between the first outer peripheral surface and the second outer peripheral surface is nipped by the first outer peripheral surface and the third outer peripheral surface thus transporting the paper in the first direction;

a controller which is configured or programmed to control an operation of the driver and the rotation of the drive roller; and a paper passing detection switch that detects a rear edge of the paper; wherein the controller is configured or programmed to, while delivering the paper after the paper is moved to a different position in the second direction, execute an operation in which:

the paper is transported due to rotation of the drive roller for a predetermined time until the rear edge of the paper in the first direction is released from nipping between the first outer peripheral surface and the second outer peripheral surface and the rear edge of the paper is nipped between the first outer peripheral surface and the third outer peripheral surface;

the rotation of the drive roller is stopped in a state where the rear edge of the paper in the first direction is nipped only between the first outer peripheral surface and the third outer peripheral surface;

the driver moves the shift frame in the second direction while the rear edge of the paper in the first direction is nipped between the first outer peripheral surface and the third outer peripheral surface; and the paper is delivered from between the drive roller and the second driven roller by rotating the drive roller.

2. The paper delivery device according to claim 1, wherein the paper delivery device performs, in an operation to deliver the paper after the paper is moved to a different position in the second direction, an operation in which:

the paper is transported due to rotation of the drive roller until the rear edge of the paper in the first direction is released from nipping between the first outer peripheral surface and the second outer peripheral surface and the rear edge of the paper is nipped between the first outer peripheral surface and the third outer peripheral surface;

the rotation of the drive roller is stopped in a state where the rear edge of the paper in the first direction is nipped only between the first outer peripheral surface and the third outer peripheral surface;

the driver moves the shift frame in the second direction while the rear edge of the paper in the first direction is nipped between the first outer peripheral surface and the third outer peripheral surface; and the paper is delivered from between the drive roller and the second driven roller by rotating the drive roller.

3. The paper delivery device according to claim 1, further comprising a biasing member that resiliently presses the first driven roller to the drive roller such that the first driven roller is movable relative to the drive roller.

4. The paper delivery device according to claim 1, wherein a distance between a rotational axis of the drive roller and a rotational axis of the second driven roller is a fixed value.

5. The paper delivery device according to claim 1, wherein the controller further includes a DIP switch and, the predetermined time is set by the DIP switch.

* * * * *